United States Patent [19]

Dannemiller

[11] Patent Number: 4,570,403

[45] Date of Patent: Feb. 18, 1986

[54] FOUNDATIONS ANCHOR FOR A MODULAR BUILDING

[75] Inventor: Timothy J. Dannemiller, Carroll, Ohio

[73] Assignee: Cardinal Industries, Inc., Columbus, Ohio

[21] Appl. No.: 545,830

[22] Filed: Oct. 27, 1983

[51] Int. Cl.[4] ..... E04B 1/41; E04C 5/16

[52] U.S. Cl. ..... 52/295; 52/712

[58] Field of Search ..... 52/295, 714, 715, 712, 52/294, 293, 480, 713, 23, DIG. 11

[56] References Cited

U.S. PATENT DOCUMENTS

| | | | |
|---|---|---|---|
| 683,443 | 10/1901 | Cooley | 52/713 |
| 851,611 | 4/1907 | Weber | 52/713 |
| 862,355 | 8/1907 | Stoneburner | 52/295 |
| 897,353 | 9/1908 | Culley | 52/714 |
| 914,867 | 3/1909 | Oliphant | 52/295 |
| 996,262 | 6/1911 | Kurtz | 52/714 |
| 1,745,858 | 2/1930 | McCarty | 52/714 |
| 3,889,441 | 6/1975 | Fortine | 52/714 |
| 3,998,026 | 12/1976 | Allen | 52/295 |
| 4,329,826 | 5/1982 | Flogaus et al. | 52/295 |

*Primary Examiner*—John E. Murtagh
*Assistant Examiner*—Caroline Dennison
*Attorney, Agent, or Firm*—William S. Rambo; William Cates Rambo

[57] ABSTRACT

Means for anchoring a prefabricated, modular building to a foundation wall takes the form of an integral sheet metal strap formed with a base flange and intermediate body section for embeddment in the foundation wall and an exposed upper, plate-like building attachment section extending outwardly from the intermediate body section above the foundation wall and formed with a weakened, bendable intermediate portion and an outer perforated plate portion for fastening to the base of the building.

1 Claim, 3 Drawing Figures

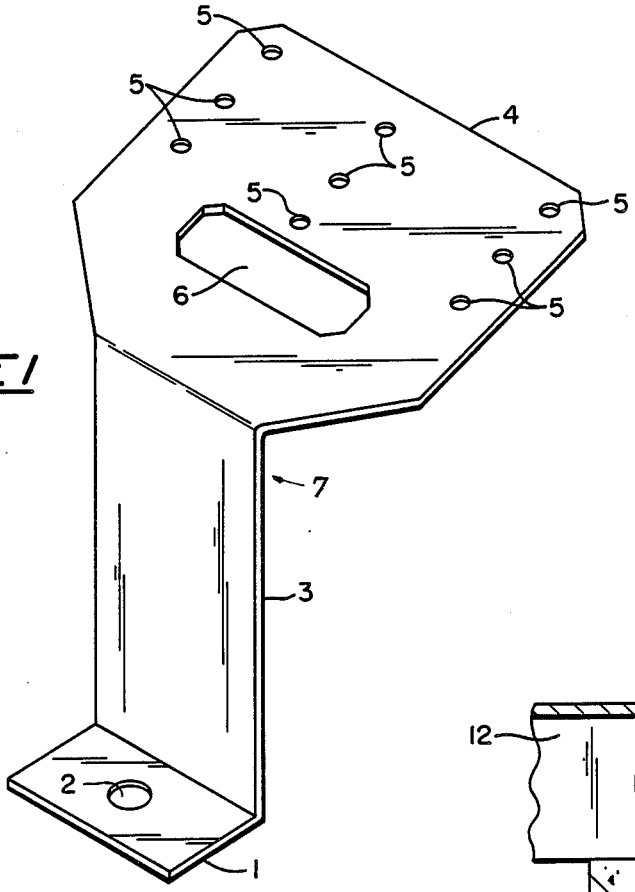
FIG. 1
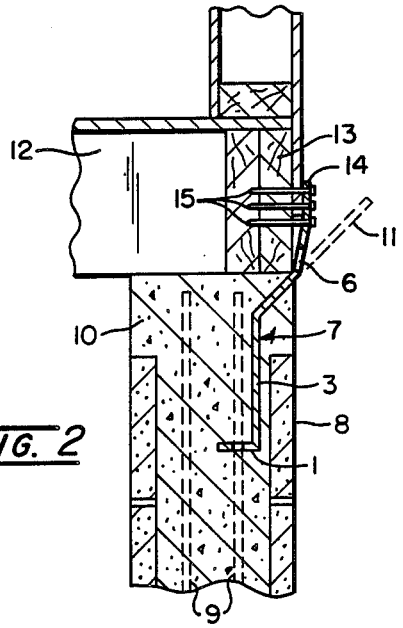
FIG. 2
FIG. 3
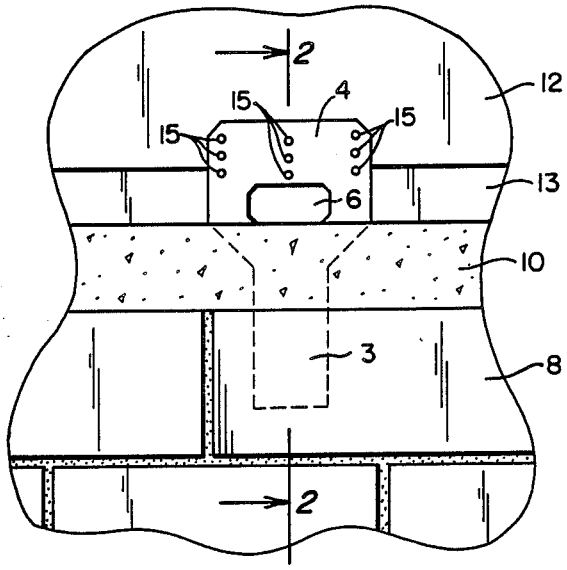

FOUNDATIONS ANCHOR FOR A MODULAR BUILDING

BACKGROUND OF THE INVENTION

This invention relates generally to prefabricated, modular buildings, and more particularly, to an improved device for securely anchoring a building module to a foundation wall to insure against its displacement in high winds.

Prefabricated, modular building units are typically manufactured in substantially finished condition at a factory remote from the ultimate building site. The modular units are then trucked to the building site, where they are positioned on suitable concrete foundation walls. Relatively little on-site work is required in order to complete the building and make it suitable for habitation.

Due to their structural integrity, prefabricated building modules or units have heretofore been difficult to anchor to a concrete foundation. While it has been previously proposed to use heavy metal cables and/or external clamps to securely fasten the module to its foundation, such cables and clamps are extremely difficult to apply and result in an overall unsightly appearance.

SUMMARY AND OBJECTS OF THE INVENTION

The present invention is an anchor strap that is easily installed in a foundation wall during the construction of the foundation. The present anchor strap includes a base flange which is joined with the reinforcing bars normally present in the foundation so that the entire foundation wall is used to resist wind loads. The anchor strap also includes an exposed bendable plate section designed to be rapidly attached to the base board of the building module by nailing, rather than by more time-consuming bolting. The present design also facilitates easy concealment of the anchor strap behind trim board of the building to thus improve the overall appearance of the structure.

A primary object of the present invention is to provide an apparatus for anchoring modular buildings to their foundations in which the entire block, concrete and reinforcing bar structure of the foundation is employed to resist high wind loads.

A further object of this invention is to provide an anchor strap which is rapidly installed via nailing.

A further object of this invention is to provide an anchor strap with a low profile, easily concealed beneath trim boards.

A further object of this invention is to provide an anchor strap which does not impede the positioning of the module on the foundation.

BRIEF DESCRIPTION OF DRAWINGS

FIG. 1 is a perspective view of an anchor strap according to this invention;

FIG. 2 is a vertical cross-sectional view of the anchor strap in its final operative position connecting a building to a foundation wall and taken approximately along the section line 2—2 of FIG. 3; and FIG. 3 is a fragmentary elevational view of the anchor strap, the building and the foundation wall.

DETAILED DESCRIPTION OF THE PREFERRED EMBODIMENT

A typical anchor strap 7 according to the present invention is shown in perspective in FIG. 1. The anchor strap may be stamped from sheet metal and bent into the shape shown in FIG. 1. The anchor strap comprises generally three functional sections, namely: a lower base flange 1, an intermediate body section 3 and an upper plate section 4. The base flange 1 is formed with a circular hole 2 of a size to receive a conventional concrete reinforcing bar 9. As will be noted, the intermediate body portion 3 of the strap is integrally joined in approximately perpendicular relation, to the base flange 1. The plate section 4 is integrally joined with the upper end of the body portion 3 and is disposed in approximately 135° obtuse angular relation thereto. The plate section 4 is formed toward its outer end with a plurality of holes 5 suitable for driving nails 15 to securely attach the anchor strap to the base board 13 of a building module 12. The plate section 4 also contains an elongated slot 6 which defines on the plate section a transversely weakened, readily bendable area in the intermediate portion of the plate section.

At a selected building site, a concrete block foundation wall 8 will be constructed and metal reinforcing bars 9 will be positioned in the core openings which pass through the blocks. As shown in FIG. 2, the anchor strap 7 is installed by inserting the base flange 1 and intermediate body portion 3 into an opening in an uppermost block of the foundation wall 8 and with a reinforcing bar 9 inserted through hole 2 in the base flange. The core openings in the foundation wall are then filled with concrete, 10, firmly anchoring the anchor strap 7 into the structure of the foundation wall. As shown by the broken lines 11 in FIG. 2, the plate section 4 of the anchor strap normally projects away from the vertical plane of the foundation wall at approximately a 45° angle. Thus, as the building module 12 is lowered into position on the foundation wall, no interference from the anchor straps is encountered. Also, the anchor strap 7 is preferably located so that the lower edge of the slot 6 is disposed flush with the upper surface of the concrete cap 10.

Following positioning of the building module 12 on the foundation, the upper plate section 4 of the anchor strap is bent by hammer blows into engagement with the base board of the module and it is then securely fastened to the base board 13 by nails 15 driven through the openings 5 of the plate section 4.

Typically, several such anchor straps will be required around the perimeter of the building to insure adequate attachment. The precise number will vary depending on the size of the structure and the degree of stability required. However, the present invention uses the reinforcing bars, and the entire footing and block wall to anchor the module against displacement under high wind loads. In view of the foregoing, it will be seen that the present invention provides an improved, easily installed and mechanically efficient foundation anchor strap for prefabricated modular building units.

While a single preferred embodiment has been illustrated and described in detail, it will be understood that various modifications in design and details of construction may be resorted to without departing from the spirit of the invention or the scope of the following claims.

I claim:

1. In a device anchoring a prefabricated building to a concrete foundation wall and which includes an integral, elongated sheet metal strap formed with a base flange having an opening therein receiving a generally vertically disposed, foundation-reinforcing bar, an intermediate body section integrally joined with and disposed in substantially perpendicular relation to said base flange, said base flange and intermediate body section being embedded in a concrete foundation wall; that improvement which comprises a relatively wider upper plate section integrally joined with and normally disposed in obtuse angular relation to said intermediate body section, said plate section being formed with an included, transversely disposed slot defining a weakened, bendable intermediate portion in said plate section and a plurality of nail-receiving openings disposed outwardly from said slot; the slot and nail-receiving openings of said plate section being arranged to extend upwardly and outwardly from a foundation wall in which the base flange and intermediate body sections of said strap are embedded and for nailed connection with the base portion of a building set on such foundation wall.

* * * * *